US012528662B2

(12) United States Patent
Kotani et al.

(10) Patent No.: US 12,528,662 B2
(45) Date of Patent: Jan. 20, 2026

(54) TRANSPORT APPARATUS HAVING DETENTION DEVICE FOR ACCOMMODATING SHEET, AND IMAGE FORMING SYSTEM INCLUDING TRANSPORT DEVICE

(71) Applicant: KYOCERA Document Solutions Inc., Osaka (JP)

(72) Inventors: Takashi Kotani, Osaka (JP); Toshiaki Inoue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/761,594

(22) Filed: Jul. 2, 2024

(65) Prior Publication Data

US 2025/0011122 A1 Jan. 9, 2025

(30) Foreign Application Priority Data

Jul. 5, 2023 (JP) ..... 2023-110689

(51) Int. Cl.

| | |
|---|---|
| ***B65H 29/60*** | (2006.01) |
| ***B65H 29/00*** | (2006.01) |
| ***B65H 29/12*** | (2006.01) |
| ***B65H 29/58*** | (2006.01) |

(52) U.S. Cl.

CPC ..... *B65H 29/60* (2013.01); *B65H 29/00* (2013.01); *B65H 29/125* (2013.01); *B65H 29/58* (2013.01); *B65H 2301/331* (2013.01); *B65H 2301/333* (2013.01); *B65H 2301/517* (2013.01)

(58) Field of Classification Search

CPC .... B65H 2301/332; B65H 2701/11312; B65H 2301/333; B65H 85/00; B65H 15/004; B65H 29/60; B65H 29/58; G03G 2215/00438; G03G 15/234

See application file for complete search history.

(56) References Cited

U.S. PATENT DOCUMENTS 8,736,859 B2 * 5/2014 Fujii ..... G06F 3/12 358/1.13

FOREIGN PATENT DOCUMENTS

JP H1086455 A 4/1998

* cited by examiner

*Primary Examiner* — Jeremy R Severson

(74) *Attorney, Agent, or Firm* — IP Business Solutions, LLC.

(57) ABSTRACT

A transport apparatus includes a transport device, a detention device, a reversing device, and a switching device. The transport device sequentially transports sheets, each having an image formed on an upper face thereof, from an image forming apparatus in a predetermined direction. The detention device accommodates therein the sheet delivered from the transport device. The reversing device reverses upper and lower faces of the sheet delivered from the transport device. The switching device switches a destination of the sheet from the transport device, between the detention device and the reversing device. The reversing device includes a reversed sheet supply route through which the reversed sheet is supplied to the image forming apparatus, and a delivery route through which the reversed sheet is discharged.

6 Claims, 5 Drawing Sheets

TRANSPORT APPARATUS HAVING DETENTION DEVICE FOR ACCOMMODATING SHEET, AND IMAGE FORMING SYSTEM INCLUDING TRANSPORT DEVICE

INCORPORATION BY REFERENCE

This application claims priority to Japanese Patent Application No. 2023-110689 filed on Jul. 5, 2023, the entire contents of which are incorporated by reference herein.

BACKGROUND

The present disclosure relates to a transport apparatus and an image forming system.

A sheet transport apparatus has lately been developed that includes a detention device for accommodating therein, in the event that a malfunction such as multifeed has been detected, sheets located on a sheet transport route.

SUMMARY

The disclosure proposes further improvement of the foregoing techniques.

In an aspect, the disclosure provides a transport apparatus including a transport device, a detention device, a reversing device, and a switching device. The transport device sequentially transports sheets, each having an image formed on an upper face thereof, from an image forming apparatus in a predetermined direction. The detention device accommodates therein the sheet delivered from the transport device. The reversing device reverses upper and lower faces of the sheet delivered from the transport device. The switching device switches a destination of the sheet from the transport device, between the detention device and the reversing device. The reversing device includes a reversed sheet supply route through which the reversed sheet is supplied to the image forming apparatus, and a delivery route through which the reversed sheet is discharged.

In another aspect, the disclosure provides an image forming system including the foregoing transport apparatus, and an image forming apparatus that forms an image on the upper face of the sheet.

DETAILED DESCRIPTION

Figure 1:
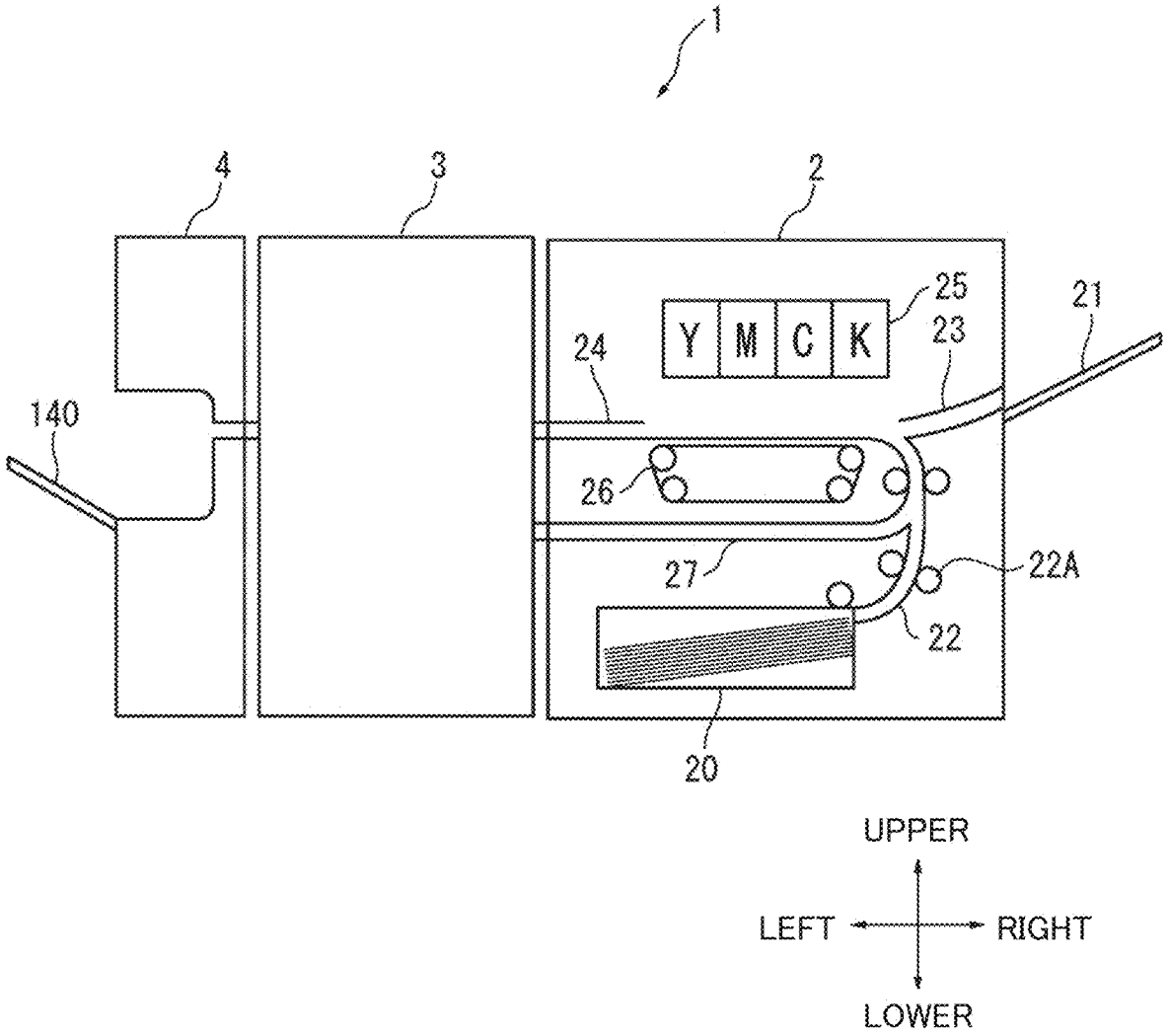
FIG. 1 is a schematic cross-sectional view showing a configuration of an image forming system, including a transport apparatus according to an embodiment.

Hereafter, a transport apparatus and an image forming system according to an embodiment of the disclosure will be described, with reference to the drawings. In the drawings, the same or corresponding elements are given the same numeral, and the description of such elements will not be repeated.

Referring first to FIG. 1, the image forming system 1 will be described. FIG. 1 is a schematic cross-sectional view showing a configuration of the image forming system 1, including the transport apparatus 3 according to the embodiment. As shown in FIG. 1, the image forming system 1 includes an image forming apparatus 2, the transport apparatus 3, and a delivery device 4.

The transport apparatus 3 is connected to the image forming apparatus 2. The transport apparatus 3 is located downstream of the image forming apparatus 2, in the transport direction of a sheet.

The delivery device 4 is connected to the transport apparatus 3. The delivery device 4 is located downstream of the transport apparatus 3, in the transport direction of the sheet. The delivery device 4 delivers the sheet transported from the transport apparatus 3. The delivery device 4 may include an output tray 140 for receiving the delivered sheet.

The image forming apparatus 2 forms an image on the sheet, on the basis of image data. The image forming apparatus 2 acquires the image data, either from a source document, or an external server, cloud, or a terminal device. The e forming apparatus 2 may be a multifunction peripheral having an image data transmission/reception function, an image reading function, and the image forming function. The image forming apparatus 2 has, for example, the functions of scanning, printing, copying, telephone communication, and facsimile transmission.

The cloud provides a computer resource through a computer network such as the internet, and includes, for example, an application, a platform, and an infrastructure.

The server preserves data, and provides the corresponding data upon receipt of a request through a communication line.

To be more specific, the image forming apparatus 2 includes a sheet feeding device 20, another sheet feeding device 21, a transport device 22, another transport device 23, another transport device 24, an image forming device 25, a transport belt 26, and a duplex transport route 27.

The sheet feeding device 20 stores therein the sheets, and feeds the sheets.

The sheet feeding device 21 is primarily used for manual sheet feeding.

The transport device 22 transports the sheet delivered from the sheet feeding device 20, toward the image forming device 25. The transport device 22 includes a transport roller 22A.

The transport device 23 transports the sheet manually supplied from the sheet feeding device 21, toward the image forming device 25.

The transport device 24 delivers the sheet to the transport apparatus 3.

The image forming device 25 forms an image on the sheet, using toner or ink. When the image forming apparatus 2 is based on the electrophotography, the image forming device 25 includes a photosensitive body, a charging device, an exposure device, a developing device, a transfer device, a cleaning device, and a static eliminator.

The photosensitive body is, for example, a photoconductor drum. The photoconductor drum includes a photosensitive layer, provided on the outer circumferential surface. Examples of the photoconductor drum include a selenium drum, and an organic photoconductor (OPC).

The charging device electrically charges the photosensitive layer of the photosensitive body, to a predetermined potential. The charging device may be, for example, a corona charger The exposure device irradiates the photosensitive layer of the photosensitive body, with a laser beam. The exposure device irradiates the photosensitive layer of the photosensitive body, on the basis of the image data. As result, an electrostatic latent image is formed on the photosensitive body. The exposure device can be typically exemplified by a light emitting diode (LED), such as a laser diode (LD).

The developing device accommodates therein, for example, a two-component developing agent containing a carrier constituted of a magnetic body, and toner. The developing device develops the electrostatic latent image formed on the photosensitive body, with the toner, thereby forming a toner image on the photosensitive body. The transfer device transfers the toner image on the photosensitive body, to the sheet. The cleaning device removes residual toner remaining on the photosensitive body after the transfer process. The static eliminator eliminates the static electricity from the photosensitive body.

When the image forming apparatus 2 is an ink jet printer, the image forming device 25 includes ink cartridges, ink tanks, pumps, a head, nozzles, and electrodes. In this embodiment, the image forming apparatus 2 will be exemplified by the ink jet printer.

The ink cartridges and the ink tanks respectively contain, for example, aqueous ink of yellow (Y), magenta (M), cyan (C), and black (Bk).

The pumps each supply the ink from the ink tank, to the head.

The head includes a multitude of nozzles that constitute pixels. To the head, the ink of the color corresponding to the image data is supplied from the ink tank, on the basis of the image data. The ink is ejected through the nozzles, onto the sheet.

The electrodes include, for example, a charging electrode and a deflection electrode. The charging electrode electrically charges the ink ejected from the nozzle. The deflection electrode controls the flying direction of the charged ink.

The transport belt 26, which transports the sheet, is opposed to the nozzles of the head. On the sheet being transported by the transport belt 26, an image is formed with the ink ejected from the nozzles of the head.

Through the duplex transport route 27, the sheet delivered from the transport apparatus 3, with the printed face oriented upward, is transported to the image forming device 25, with the unprinted face oriented upward (printed face oriented downward).

Figure 2:
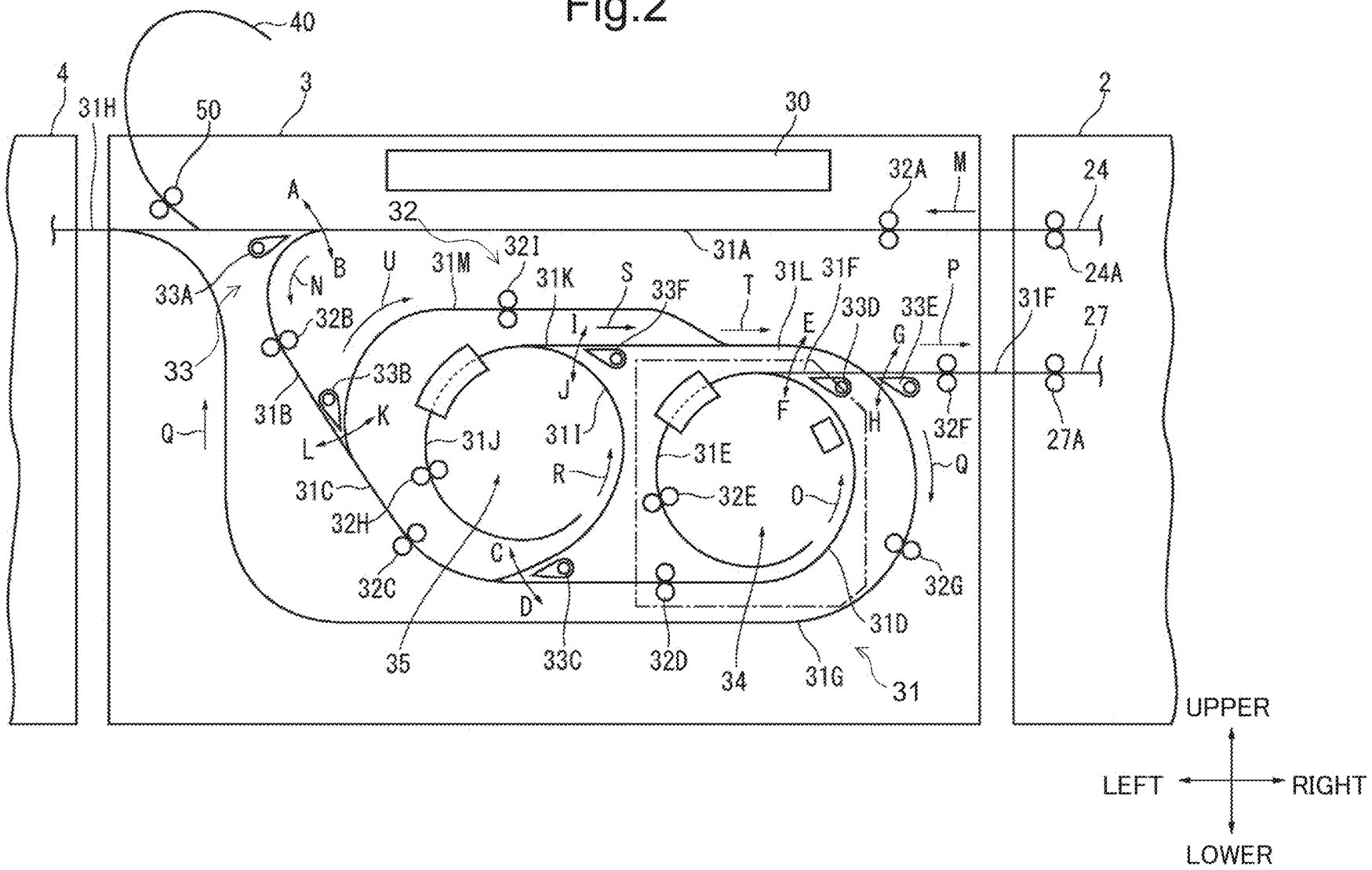
FIG. 2 is a schematic drawing showing a configuration of the transport apparatus according to the embodiment.

Referring now to FIG. 1 and FIG. 2, the transport apparatus 3 according to this embodiment will be described hereunder. FIG. 2 illustrates a configuration of the transport apparatus 3 according to this embodiment. As shown in FIG. 2, the transport apparatus 3 includes a drying device 30, a transport device 31, transport rollers 32, switching devices 33, a first drum transport device 34, and a second drum transport device 35. The first drum transport device 34 and the second drum transport device 35 exemplify the reversing device in the disclosure.

The transport rollers 32 include a transport roller 32A, a transport roller 32B, a transport roller 32C, a transport roller 32D, a transport roller 32E, a transport roller 32F, a transport roller 32G, a transport roller 32H, and a transport roller 32I. The transport rollers 32 each include a motor and a driver acting as the drive source, to be driven under the control of a controller 62 (see FIG. 5).

The switching devices 33 include a switching device 33A, a switching device 33B, a switching device 33C, a switching device 33D, a switching device 33E, and a switching device 33F. The switching devices 33 each include a motor and a driver acting as the drive source, to be driven under the control of the controller 62.

The transport device 31 includes a transport route 31A, a reversing transport route 31B, a reversing transport route 31C, a first siding transport route 31D, a first siding transport route 31E, a first U-turn transport route 31F, and a first delivery transport route 31H. The transport route 31A exemplifies the transport device in the disclosure. The first U-turn transport route 31F exemplifies the reversed sheet supply route in the disclosure.

The transport route 31A extends from the transport device 24 of the image forming apparatus 2, in the direction of an arrow M (to the left). The direction of the arrow M exemplifies the predetermined direction in the disclosure. The sheet delivered from the transport device 24 of the image forming apparatus 2 is transported in the direction of the arrow M, along the transport route 31A.

The printed face (upper face) of the sheet being transported in the direction of the arrow M, by the transport roller 32A of the transport apparatus 3, is dried by the drying device 30.

The first delivery transport route 31H extends from the transport route 31A to the delivery device 4.

The reversing transport route 31B is continuous from the transport route 31A, and extends from the transport route 31A in the direction of an arrow N-direction, so as to be branched from the first delivery transport route 31H. The sheet transported along the transport route 31A in the direction of the arrow M is transported along the reversing transport route 31B, in the direction of the arrow N.

The switching device 33A is configured to be shifted between the side of an arrow A and the side of an arrow B. When the switching device 33A is shifted to the side of the arrow B, the sheet is transported along the delivery transport route 31H, and delivered to the delivery device 4. When the switching device 33A is shifted to the side of the arrow A, the sheet is transported along the reversing transport route 31B in the direction of the arrow N, by the transport roller 32B.

The reversing transport route 31C is continuous from the reversing transport route 31B, and extends from the position corresponding to the switching device 33A to the position corresponding to the switching device 33C, via the position corresponding to the switching device 33B. The sheet that has been transported along the reversing transport route 31B is continuously transported along the reversing transport route 31C, in the direction of the arrow N.

The switching device 33C is configured to be shifted between the side of an arrow C and the side of an arrow D. When the switching device 33C is shifted to the side of the arrow C, the sheet that has been transported along the transport route 31A, the reversing transport route 31B, and the reversing transport route 31C, is transported by the transport roller 32C, the transport roller 32D, and the transport roller 32E, to the first siding transport route 31D and the first siding transport route 31E of the first drum transport device 34.

The first siding transport route 31D is continuous from the reversing transport route 31C, from the position corresponding to the switching device 33C, and extends in the direction of an arrow O, to the first drum transport device 34.

The first siding transport route 31E is continuous from the first siding transport route 31D, and forms the first drum transport device 34. To be more detailed, the first siding transport route 31E and a part of the first siding transport route 31D constitute the first drum transport device 34. Along the first siding transport route 31E, the sheet from the first siding transport route 31D is continuously transported, in the direction of the arrow O.

The sheet transported to the first drum transport device 34 is retracted into the first siding transport route 31E, after being transported along the first siding transport route 31D, until the trailing edge of the sheet reaches a position downstream of the switching device 33D, in the transport direction.

The first U-turn transport route 31F is branched from the first siding transport route 31D, at the position corresponding to the switching device 33D.

The switching device 33D is configured to be shifted between the side of an arrow E and the side of an arrow F. When the switching device 33D is shifted to the side of the arrow F, the transport roller 32E and the transport roller 32F of the transport apparatus 3 transport the sheet, in the direction of an arrow P.

The sheet switched back from the first siding transport route 31E is transported to the image forming apparatus 2, via the first U-turn transport route 31F. The sheet that has entered the image forming apparatus 2 is transported by the transport roller 27A along the duplex transport route 27, with the printed face oriented upward.

As shown in FIG. 1, the sheet transported along the duplex transport route 27 is turned upside down (printed face is turned to be oriented downward), when being transported to the transport device 24, and subjected to the duplex printing operation by the image forming device 25.

Further, the transport device 31 also includes a first delivery transport route 31G, a second siding transport route 31I, a second siding transport route 31J, a second U-turn transport route 31K, and a second U-turn transport route 31L. The first delivery transport route 31G exemplifies the delivery route in the disclosure.

When the switching device 33C is shifted to the side of the arrow D, the sheet that has been transported along the reversing transport route 31A, the reversing transport route 31B, and the reversing transport route 31C, is transported by the transport roller 32C and the transport roller 32H, to the second siding transport route 31I and the second siding transport route 31J of the second drum transport device 35.

The second drum transport device 35 includes the second siding transport route 31I, the second siding transport route 31J, and the second U-turn transport route 31K.

The second siding transport route 31I is continuous from the reversing transport route 31C, and branched from the first siding transport route 31D. The second siding transport route 31I serves to retract therein the sheet that has been transported along the reversing transport route 31A, the reversing transport route 31B, and the reversing transport route 31C.

The second U-turn transport route 31K and the second U-turn transport route 31L are branched from the second siding transport route 31I and the second siding transport route 31J, at the position corresponding to the switching device 33F.

The switching device 33F is configured to be shifted between the side of an arrow I and the side of an arrow J. When the switching device 33F is shifted to the side of the arrow J, the transport roller 32H of the transport apparatus 3 transports the sheet, in the direction of an arrow S and an arrow T.

The switching device 33E is configured to be shifted between the side of an arrow G and the side of an arrow H. When the switching device 33E is shifted to the side of the arrow H, the transport roller 32E and the transport roller 32J of the transport apparatus 3 transport the sheet in the direction of the arrow P. The sheet that has entered the image forming apparatus 2 is transported by the transport roller 27A along the duplex transport route 27, with the printed face oriented upward.

As shown in FIG. 1, the sheet transported along the duplex transport route 27 is turned upside down (printed face is turned to be oriented downward), when being transported to the transport device 24, and subjected to the duplex printing operation by the image forming device 25.

The first delivery transport route 31G is connected to the first delivery transport route 31H, at the downstream end in the transport direction of the sheet. The first delivery transport route 31H extends to the delivery device 4.

The first delivery transport route 31G and the first delivery transport route 31H are branched from the first U-turn transport route 31F, to transport the sheet, switched back along the second U-turn transport route 31L, to the delivery device 4. In other words, the first U-turn transport route 31F is branched, at the position corresponding to the switching device 33E, to the first U-turn transport route 31F extending toward the image forming apparatus 2, and the first delivery transport route 31G.

When the switching device 33F is shifted to the side of the arrow J, and the switching device 33E is shifted to the side of the arrow G, the transport roller 32H and the transport roller 32G of the transport apparatus 3 transport the sheet in the direction of an arrow Q, from the second U-turn transport route 31K and the second U-turn transport route 31L, to the second delivery transport route 31G and the second delivery transport route 31H. Accordingly, the sheet is delivered to the delivery device 4, in the face-down orientation.

The transport device 31 further includes an elongate sheet transport route 31M.

The switching device 33B is configured to be shifted between the side of an arrow K and the side of an arrow L. When the switching device 33B is shifted to the side of the arrow L, the sheet is transported by the transport roller 32D, the transport roller 32C, and the transport roller 32I, along the elongate sheet transport route 31M, in the direction of an arrow U.

Further, the switching device 33E is shifted to the side of the arrow H, and the transport roller 32F transports the sheet in the direction of the arrow P. Accordingly, the duplex printing operation is performed in the image forming apparatus 2. In contrast, when the switching device 33E is shifted to the side of the arrow G, the transport roller 32G transports the sheet from the second U-turn transport route 31L to the second delivery transport route 31G and the second delivery transport route 31H, in the direction of the arrow Q. Accordingly, the elongate sheet is delivered to the delivery device 4, in the face-down orientation.

Still further, the transport apparatus 3 includes a detention device 40. The detention device 40 serves to accommodate therein the sheet delivered from the transport route 31A. Therefore, in this embodiment, the detention device 40 can accommodate the sheet having an image formed on the upper face thereof. In addition, the unused space on the upper side can be effectively utilized. Further, the sheet located close to the drying device 30 can be accommodated in the detention device 40.

Figure 3:
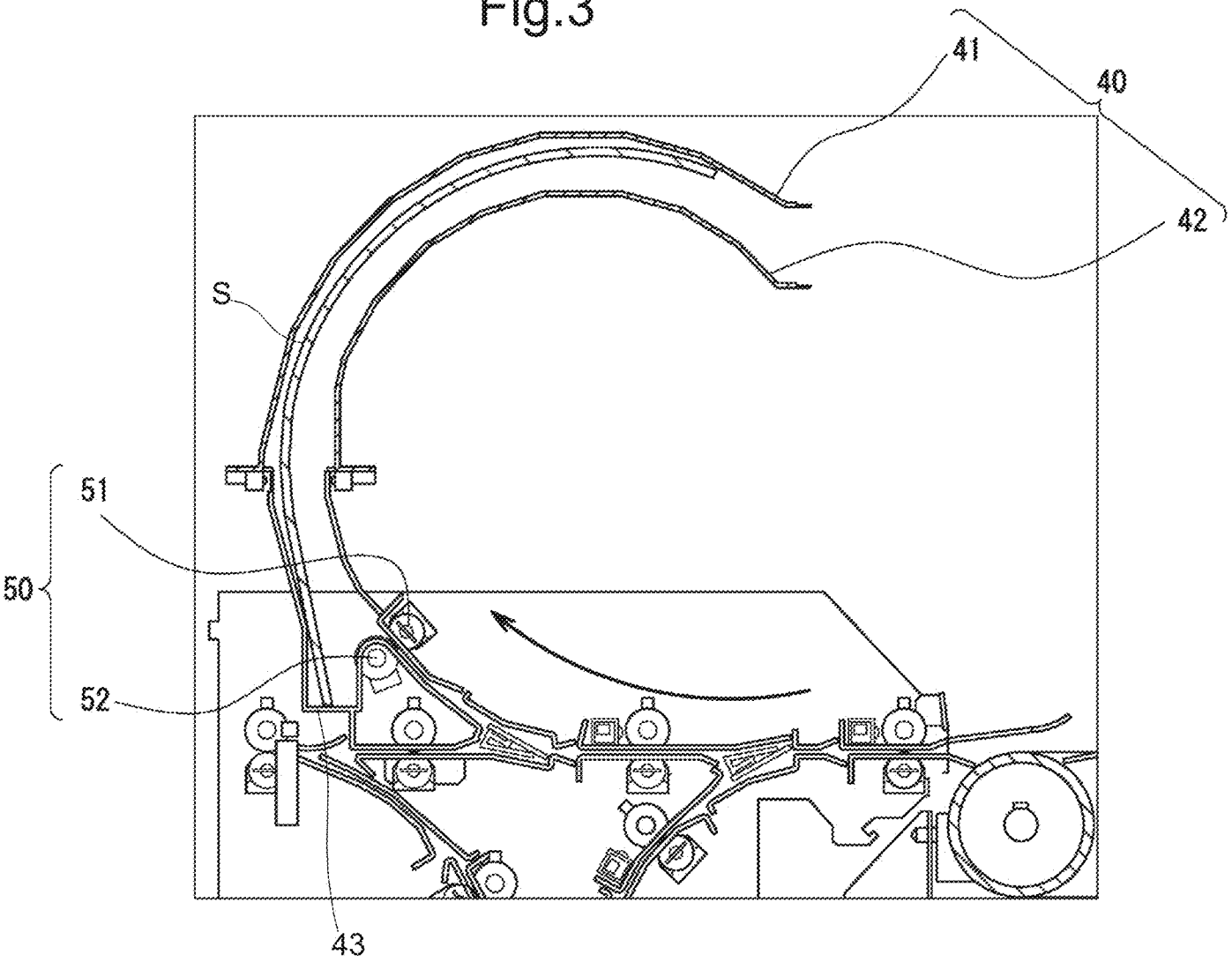
FIG. 3 is an enlarged cross-sectional view of a detention device according to the embodiment.
Figure 4:
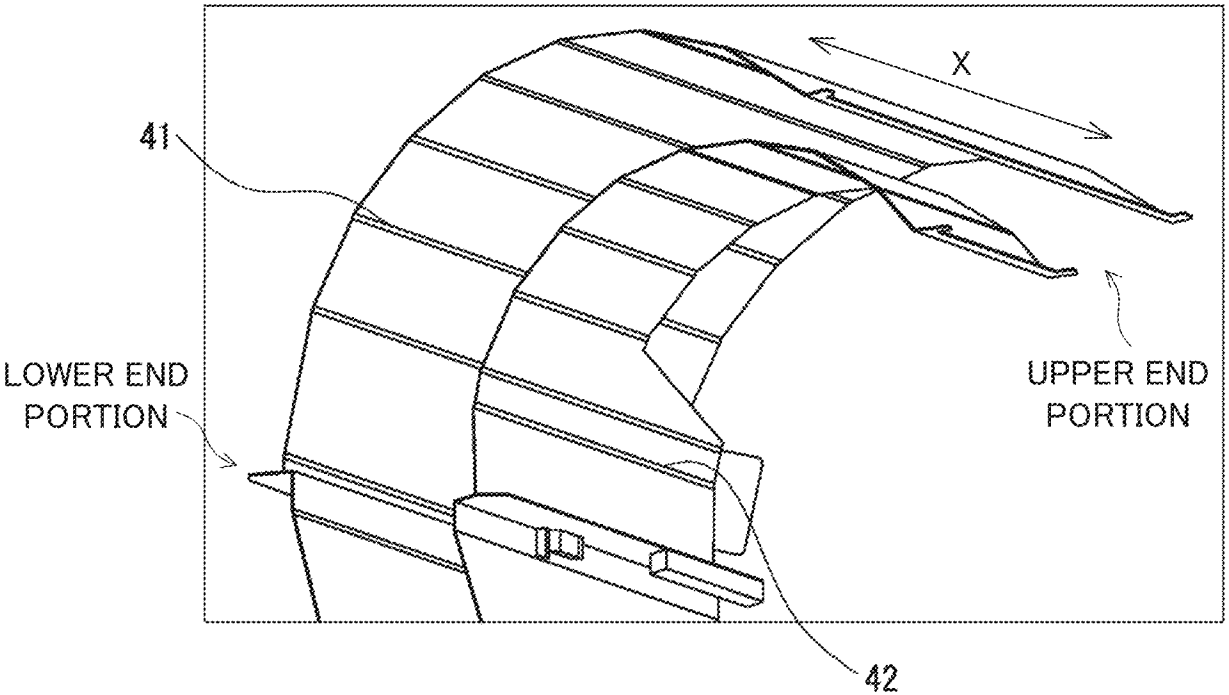
FIG. 4 is a perspective view showing the detention device according to the embodiment.

Referring now to FIG. 1 to FIG. 4, the detention device 40 according to this embodiment will be described in detail. FIG. 3 is an enlarged cross-sectional view of the detention device 40 according to this embodiment. FIG. 4 is a perspective view showing the detention device 40 according to this embodiment. As shown in FIG. 3 and FIG. 4, the detention device 40 has a semicylindrical shape.

The detention device 40 includes an upper semicylindrical body 41, and a lower semicylindrical body 42. The lower semicylindrical body 42 is opposed to the upper semicylindrical body 41 with a clearance therebetween, and located on the inner side of the upper semicylindrical body 41. The sheet is accommodated between the upper semicylindrical body 41 and the lower semicylindrical body 42.

The lower semicylindrical body 42 is shorter in length in the width direction, than the upper semicylindrical body 41. Here, the width direction refers to the direction orthogonal to the transport direction of the sheet (X-direction in FIG. 4). Making thus the lower semicylindrical body 42 shorter in the width direction than the upper semicylindrical body 41, facilitates the user to manually take out the sheet from the detention device 40, with a simple structure.

In this embodiment, the difference in length in the width direction, between the upper end portion of the lower semicylindrical body 42 and the upper end portion of the upper semicylindrical body 41, is larger than the difference in length between the lower end portion of the lower semicylindrical body 42 and the lower end portion of the upper semicylindrical body 41. Such a configuration further facilitates the user to manually take out the sheet from the detention device 40, with a simple structure.

The transport apparatus 3 further includes a drive device 50. The drive device 50 delivers the sheet that has been transported along the transport route 31A, to the detention device 40.

The drive device 50 is located on the lower end portion of the detention device 40. To be more specific, the drive device 50 includes an upper roller 51 and a lower roller 52, opposed to each other. The leading edge of the sheet transported along the transport route 31A in the face-up orientation is guided to the nip region between the upper roller 51 and the lower roller 52, and made to proceed toward the upper end portion of the lower semicylindrical body 42 and the upper semicylindrical body 41, by the rotation of the upper roller 51 and the lower roller 52. Accordingly, the sheet is accommodated in the detention device 40, with the upper face opposed to the inner side of the semicylindrical space, in other words to the lower semicylindrical body 42. The detention device 40 sequentially accommodates the sheets transported along the transport route 31A, in the same posture. The drive device 50 includes a motor and a driver serving as the drive source of the u rollers, and is controlled by the controller 62.

To be more detailed, the sheet S introduced into the detention device 40, by the rotation of the upper roller 51 and the lower roller 52 of the drive device 50, falls downward after being released from the nip region between the upper roller 51 and the lower roller 52, and the trailing edge of the sheet in the transport direction falls on a bottom portion 43 of the detention device 40, as shown in FIG. 4. Such action of dropping the sheet S onto the bottom portion 43 of the detention device 40 may be referred to as draw and drop of the sheet S. The upper roller 51 and the lower roller 52 are located so as not to interfere with the trailing edge of the sheet S dropping as above.

Figure 5:
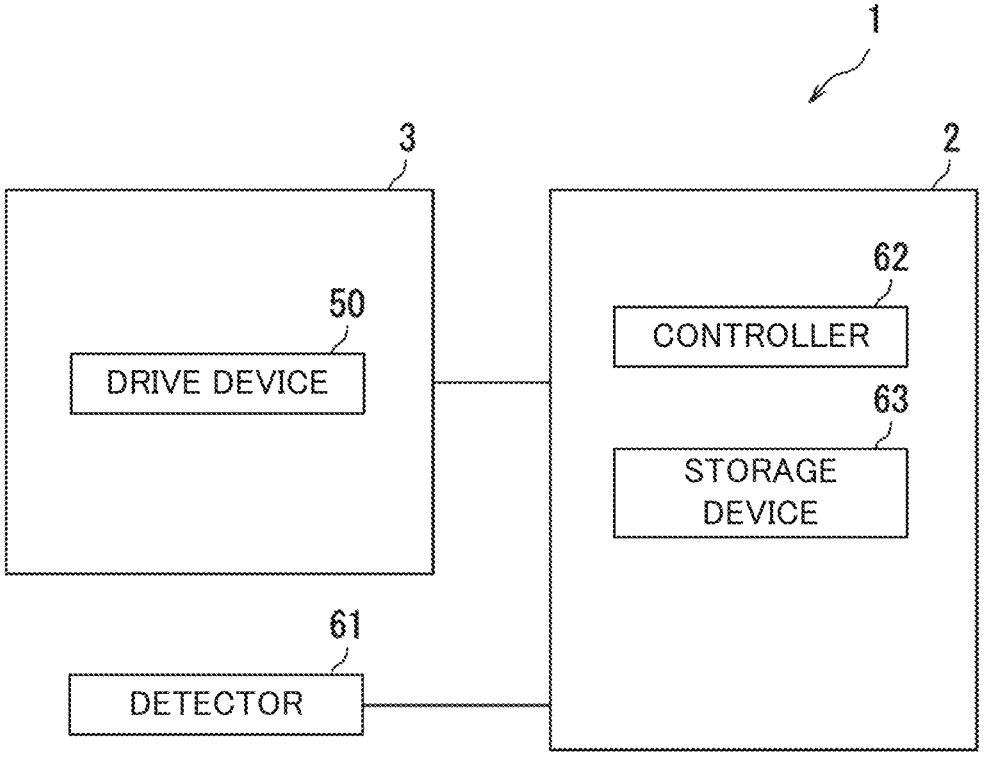
FIG. 5 is a block diagram showing the configuration of the image forming system according to the embodiment.

Referring to FIG. 5, the image forming system 1 according to this embodiment will be described in detail. FIG. 5 is a block diagram showing the configuration of the image forming system 1 according to this embodiment. As shown in FIG. 5, the image forming system 1 further includes a detector 61, the controller 62, and a storage device 63. The detector 61 detects abnormality in the transport apparatus 3 and the image forming apparatus 2. To be more specific, the detector 61 is located at a predetermined position in each of the transport apparatus 3 and the image forming apparatus 2, to detect a paper jam at the corresponding position, in the transport apparatus 3 and the image forming apparatus 2.

The controller 62 and the storage device 63 are provided in the transport apparatus 3 or the image forming apparatus 2. The storage device 63 contains control programs. The storage device 63 includes, for example, a read-only memory (ROM), a random-access memory (RAM), and/or a solid-state drive (SSD). The storage device 63 may include an external memory. The external memory includes a removable medium. The storage device 63 may include, as the external memory, a universal serial bus (USB) memory and/or a secure digital (SD) card.

The controller 62 is, for example, a processor. The processor is, for example, a central processing unit (CPU). The controller 62 performs the control operation for the transport apparatus 3, by executing the control program stored in the storage device 63.

The controller 62 controls the switching device 33A, on the basis of the detection result from the detector 61. To be more specific, upon detecting a paper jam in the transport apparatus 3, on the basis of the output from the detector 61, the controller 62 shifts the switching device 33A to the side of the arrow B (see FIG. 2). Accordingly, the sheet transported on the transport route 31A is guided to the detention device 40. In other words, in this embodiment, when the sheet being transported on the transport route 31A is about to proceed to a position downstream of the switching device 33A in the transport direction, such sheet can be guided toward the detention device 40, by shifting the switching device 33A to the side of the arrow B-direction. In contrast, in the case where the paper jam is not detected, the controller 62 shifts the switching device 33A to the side of the arrow A (see FIG. 2). Accordingly, the sheet transported on the transport route 31A is guided to the reversing transport route 31B.

In addition, the controller 62 controls the drive device 50. In other words, the controller 62 controls the rotation of the upper roller 51 and the lower roller 52. More specifically, the controller 62 causes the upper roller 51 and the lower roller 52 to rotate, thereby transporting the sheet into the detention device 40, and stops the rotation of the upper roller 51 and the lower roller 52, after the trailing edge of the sheet is released from the nip region between the upper roller 51 and the lower roller 52. Then, after the lower end of the falling sheet has passed the position corresponding to the upper roller 51 and the lower roller 52, the controller 62 resumes the rotation of the upper roller 51 and the lower roller 52, at the time that the leading edge of the sheet, to be introduced into the detention device 40 next, is about to reach the position of the upper roller 51 and the lower roller 52. Therefore, the sheets can be successively introduced into the detention device 40, without the leading edge of the next sheet, from the transport route 31A, colliding with the trailing edge of the preceding sheet, inside the detention device 40, so that the trailing edge of the preceding sheet can smoothly fall onto the bottom portion 43 of the detention device 40.

Unlike the foregoing embodiment, an existing sheet transport apparatus is only configured to supply the sheet to the image forming apparatus, and not configured to accommodate the sheet, having an image formed thereon, in the detention device, in the event that abnormality has been detected. In contrast, the transport apparatus according to the embodiment can accommodate the sheet having an image formed thereon in the detention device 40, when abnormality has been detected.

The embodiment of the disclosure has been described as above, with reference to the drawings. However, the disclosure is not limited to the foregoing embodiment, but may be modified in various manners, without departing from the scope of the disclosure. In addition, various disclosures may be created, by properly combining a plurality of elements described in the foregoing embodiment. For example, some elements may be excluded from all the elements described in the embodiment, or elements from different embodiments may be combined as desired. The drawings each schematically illustrate the elements for the sake of clarity, and the thickness, length, number of pieces, and interval of the illustrated elements may be different from the actual ones, because of the convenience in making up the drawings. Further, the material, shape, and size of the elements referred to in the foregoing embodiment are merely exemplary and not specifically limited, and may be modified as desired, without substantially departing from the configuration according to the disclosure.

INDUSTRIAL APPLICABILITY

The disclosure is advantageously applicable to a transport apparatus.

What is claimed is:

1. A transport apparatus comprising:

a transport device that sequentially transports sheets, each having an image formed on an upper face thereof, from an image forming apparatus in a predetermined direction;

a detention device that accommodates therein the sheet delivered from the transport device;

a reversing device that reverses upper and lower faces of the sheet delivered from the transport device; and a switching device that switches a destination of the sheet from the transport device, between the detention device and the reversing device, wherein the reversing device includes a reversed sheet supply route through which the reversed sheet is supplied to the image forming apparatus, and a delivery route through which the reversed sheet is discharged.

2. The transport apparatus according to claim 1, wherein the detention device has a semicylindrical shape, and accommodates the sheet such that the upper face of the sheet is oriented to an inner side of a curve of the semicylindrical shape.

3. The transport apparatus according to claim 2, wherein the detention device includes:

an upper semicylindrical body; and a lower semicylindrical body opposed to the upper semicylindrical body with a clearance, and located on the inner side of the curve of the upper semicylindrical body, the upper semicylindrical body and the lower semicylindrical body are configured to accommodate the sheet therebetween, and the lower semicylindrical body is shorter in length in a width direction, orthogonal to a transport direction of the sheet, than the upper semicylindrical body.

4. The transport apparatus according to claim 1, further comprising a drive device that supplies the sheet delivered from the transport device to the detention device, wherein the drive device includes:

an upper roller; and a lower roller opposed to the upper roller.

5. The transport apparatus according to claim 4, further comprising a controller that controls rotation of the upper roller and the lower roller, wherein the controller stops the rotation of the upper roller and the lower roller, after a trailing edge of the sheet, introduced into the detention device by the rotation of the upper roller and the lower roller, is released from a nip region between the upper roller and the lower roller, and resumes the rotation of the upper roller and the lower roller, after the trailing edge of the sheet which is falling has reached a position lower than the upper roller and the lower roller, and at a time that a leading edge of the sheet, scheduled to be introduced into the detection device next, is about to be guided into the detention device.

6. An image forming system comprising:

the transport apparatus according to claim 1; and an image forming apparatus that forms an image on the upper face of the sheet.

* * * * *